US005352569A

United States Patent [19]

Takada

[11] Patent Number: 5,352,569

[45] Date of Patent: Oct. 4, 1994

[54] SILVER HALIDE COLOR PHOTOGRAPHIC MATERIAL

[75] Inventor: Kiyohito Takada, Kanagawa, Japan

[73] Assignee: Fuji Photo Film Co., Ltd., Kanagawa, Japan

[21] Appl. No.: 110,730

[22] Filed: Aug. 23, 1993

[30] Foreign Application Priority Data

Aug. 26, 1992 [JP] Japan ..... 4-248953

[51] Int. Cl.[5] ..... G03C 1/46

[52] U.S. Cl. ..... 430/504; 430/503; 430/523; 430/530; 430/950; 430/539; 430/961; 430/965

[58] Field of Search ..... 430/503, 523, 530, 950, 430/539, 961, 504, 965

[56] References Cited

U.S. PATENT DOCUMENTS

| | | | |
|---|---|---|---|
| 5,057,407 | 10/1991 | Okamura et al. | 430/523 |
| 5,085,981 | 2/1992 | Himmelmann et al. | 430/523 |
| 5,122,445 | 6/1992 | Ishigaki | 430/523 |
| 5,200,310 | 4/1993 | Ohshima | 430/567 |
| 5,208,139 | 5/1993 | Ishigaki | 430/523 |

FOREIGN PATENT DOCUMENTS

| | | |
|---|---|---|
| 6177044 | 5/1984 | Japan . |
| 61-48853 | 3/1986 | Japan . |
| 61-147248 | 7/1986 | Japan . |
| 61-48851 | 8/1987 | Japan . |
| 1142630 | 6/1989 | Japan . |

OTHER PUBLICATIONS

Research Disclosure, Item 307105, Section XVI, "Matting Agents", pp. 878–879, Nov., 1989.

*Primary Examiner*—Thomas R. Neville

*Attorney, Agent, or Firm*—Birch, Stewart, Kolasch & Birch

[57] ABSTRACT

A silver halide color photographic material comprising a support having thereon a cyan color-forming silver halide emulsion layer, a magenta color-forming silver halide emulsion layer, a yellow color-forming silver halide emulsion layer and at least one light-insensitive hydrophilic layer disposed farther from the support than any of these silver halide emulsion layers, in which the light-insensitive hydrophilic layer contains non-globular fine-particle powder in a dispersion in an amount of at least 25% by weight based on the whole components therein, thereby ensuring excellent tone reproduction in the images and reduced dependence of image qualities upon the positions of viewing light sources. In addition, the color photographic material can provide images well-expressing a feeling of massiveness even in rapid photographic processing.

13 Claims, No Drawings

SILVER HALIDE COLOR PHOTOGRAPHIC MATERIAL

FIELD OF THE INVENTION

The present invention relates to a silver halide color photographic material and, more particularly, to a silver halide color photographic material which makes it feasible to easily produce color photographs having excellent tone reproduction and reduced dependence on the positions of viewing light sources, and further to a silver halide color photographic material which has an improvement in rapid processing suitability and forms images well-expressing a feeling of massiveness.

BACKGROUND OF THE INVENTION

It is important for a silver halide color photographic material to ensure excellent qualities in the color images after photographic processing.

In general, a silver halide color photographic material has on a support at least one silver halide emulsion layer, and usually has on said emulsion layer a surface layer (protective layer) containing as a binder a hydrophilic colloidal substance represented by gelatin. In viewing images produced in the photographic material of the above-described type through a photographic processing, it frequently occurs that it is difficult for viewers to get a good look at the images because they are dazzled by the light reflected on the surface of the photographic material.

In order to reduce the reflection of light as described above, there has been adopted a method of securing the matting effect by incorporating fine particles of an inorganic material, such as silica, titania, magnesia, etc., or an organic material, such as polymethylmethacrylate, cellulose acetate, cellulose propionate, etc., in the surface or interior part of a photosensitive material. For instance, JP-A-61-147248 (the term "JP-A" as used herein means an "unexamined published Japanese patent application") discloses the art of making an improvement in surface gloss by incorporating colloidal silica having an average particle size of no greater than 100 μm in the surface layer of a photosensitive material.

On the other hand, JP-A-01-142630 discloses the color print material in which a support whose surface has specular reflectivity or secondary diffuse reflectance is used and the surface gloss of the topmost layer arranged on the side where the light-sensitive layers are coated is controlled to 70-5%, thereby succeeding in reducing the feelings of glare and roughness on the surface.

With respect to further arts of using fine particles as cited above in a photosensitive material, there have been proposed some methods for the purpose of making an improvement in the surface adhesiveness of a photosensitive material in addition to the viewpoint of reducing the reflection of light on the surface, wherein fine particles as cited above are incorporated in the topmost layer or the backing layer of the photosensitive material to increase the surface roughness of the photosensitive material, that is, to render the surface matte, thereby reducing the adhesiveness. Those methods are disclosed, e.g., in JP-A-61-48851, JP-A-61-48853, JP-A-61-77044 and so on.

However, the above-cited methods are still unsatisfactory although they positively bring about an improvement in surface gloss, because the light reflected on the photosensitive material of the above-described kind changes its intensity depending on the positions of viewing light sources to make the viewing in some direction difficult after all. In portraits and the like which require of the images to have the power of delicate expression, it becomes an important problem that the reflection phenomenon of the above-described type causes a subtle change of the tone reproduction in the images and further makes the images lose a feeling of massiveness. Thus, it has been desired to develop the arts of settling these issues.

SUMMARY OF THE INVENTION

Therefore, an object of the present invention is to provide a silver halide color photographic material which ensures excellent tone reproduction in the images after photographic processing, has reduced dependence of the image qualities on the positions of viewing light sources and an improvement in rapid processing suitability, and produces images well expressing a feeling of massiveness.

As a result of our intensive investigation of the above-described problem, it has now been found that the problem can be solved by a silver halide color photographic material defined in the following section (1), preferably silver halide color photographic materials defined in the following sections ( 2 ) to ( 8 ) respectively:

(1) A silver halide color photographic material comprising a support having thereon a cyan color-forming silver halide emulsion layer, a magenta color-forming silver halide emulsion layer, a yellow color-forming silver halide emulsion layer and at least one light-insensitive hydrophilic layer disposed farther from the support than any of these silver halide emulsion layers, wherein the light-insensitive hydrophilic layer contains nonglobular fine-particle powder in a dispersion in an amount of at least 25% by weight based on the whole components therein.

(2) The silver halide color photographic material described in the above section (1), wherein the support is a reflecting support.

(3) The silver halide color photographic material described in the above section (1) or (2), wherein the light-insensitive hydrophilic layer containing nonglobular fine-particle powder is a photographic layer disposed on the emulsion layer-coated side, and that farthest from the support.

(4) The silver halide color photographic material described in the above section (1), (2) or (3), wherein the cyan color-forming silver halide emulsion layer, the magenta color-forming silver halide emulsion layer and the yellow color-forming silver halide emulsion layer each contain a high silver chloride emulsion having a high silver chloride content of from 95 to 99.9 mole %.

(5) The silver halide color photographic material described in the above section (1), (2), (3) or (4), wherein the nonglobular fine-particle powder has an average particle size of from 0.6 to 5 μm.

(6) The silver halide color photographic material described in the above section (1), (2), (3), (4) or (5), wherein the amount of the nonglobular fine-particle powder is at least 35% by weight based on the whole components of the light-insensitive hydrophilic layer.

(7) The silver halide color photographic material described in the above section (1), (2), (3), (4) or (5), wherein the amount of the nonglobular fine-particle powder is at least 50% by weight based on the whole components of the light-insensitive hydrophilic layer.

(8) The silver halide color photographic material described in the above section (1), (2), (3), (4), (5), (6) or (7), wherein the nonglobular fine-particle powder comprises an inorganic substance.

DETAILED DESCRIPTION OF THE INVENTION

The nonglobular fine-particle powder of the present invention is described below in detail.

The present nonglobular fine-particle powder is the powder of a substance of the kind which can be dispersed into a hydrophilic binder, an average particle size of the powder ranges preferably from 0.2 to 30 μm, more preferably from 0.6 to 5 μm. The term "nonglobular fine particles" as used herein refers to the particles having at least one face other than convex faces, and to the particles having such a shape that the surface thereof does not have an uniform curvature. The particle sizes of the nonglobular fine particles can be measured with a light microscope, scanning and transmission electron microscopes, or a Coulter counter. In determining the average particle size of nonglobular fine particles, 300 particles are arbitrarily chosen, their volumes are expressed in the volumes of corresponding spheres, and the average of the diameters of the spheres is calculated. The thus determined average value is defined as the average particle size.

As for the substance which can constitute the nonglobular fine particles, inorganic substances are preferred. Specific examples of such inorganic substances include inorganic oxides (such as silica, titania, magnesia, alumina), alkaline earth metal salts (e.g., sulfates and carbonates, specifically including barium sulfate, calcium carbonate, magnesium sulfate and so on), glass and so on. In particular, silica (silicon dioxide) can be used to great advantage. Both pure silica and an impure silica containing alumina, sodium aluminate or/and the like as minor components can serve the purpose. Also, colloidal silica, or silica in a colloidal state, can be used advantageously. The colloidal silica may contain as a stabilizer an inorganic base, such as sodium hydroxide, potassium hydroxide, ammonia, etc., or an organic base such as tetramethyl ammonium ion. The expression "particles comprises an inorganic substance" concerning the particles preferred in the present invention means that the inorganic substance constituting the particles may contain such an organic base as described above.

For the preparation of the nonglobular fine-particle powder, conventional methods can be employed. Taking the case of silica, such fine particles can be prepared according to the dry process in which $SiCl_4$ is used mainly as starting material; or they can be prepared using mainly sodium silicate as starting material, making the reaction product go through the sol state and neutralizing it with an acid or the like. Also, once prepared silica powder can be processed again (chemically and/or mechanically) to render it nonglobular.

The light-insensitive hydrophilic layer disposed farther from the support than any of those silver halide emulsion layers is a layer containing a hydrophilic colloidal substance as a binder, specifically an ultraviolet absorbing layer or a protective layer. Examples of a hydrophilic colloidal substance which can be used include gelatin and gelatin derivatives such as phthaloylated gelatin, malonoylated gelatin, etc.. Also, part or all of gelatin or a gelatin derivative can be replaced by albumin, agar, gum arabic, alginic acid, casein, partially hydrolyzed cellulose, polyvinyl alcohol, polyacrylic acid or a copolymer comprising such a vinyl compound as cited above. Hydrophilic colloidal substances preferred in the present invention are macromolecular compounds containing an amino group, especially gelatin.

To the foregoing light-insensitive hydrophilic layer disposed far from the support, there may be added, for instance, a slipping agent, an ultraviolet absorbent, an organic fluorine-containing compound, a stain inhibitor (e.g., hydroquinone derivatives), a development stopping agent, a development inhibitor releasing agent and so on. Also, these agents may be incorporated in oil droplets. An appropriate size of these oil droplets ranges from 0.01 to 20 μm, preferably from 0.05 to 10 μm. Useful substances for forming these oil droplets are high boiling organic solvents used for dispersion of photographic couplers. The high boiling organic solvents are preferably those having a boiling point of no lower than 180° C., and disclosed, e.g., in U.S. Pat. No. 2,322,027.

In the light-insensitive hydrophilic layer disposed farther from the support than any of the silver halide emulsion layers, it is necessary for the nonglobular fine-particle powder to be contained in an amount of at least 25% by weight based on the whole components therein. Additionally, it is desirable for the powder to be contained in an amount of at least 35% by weight, most desirably from 50 to 95% by weight, based on the whole components in that layer. This is because the efficacy in mitigation of light reflection is marred when the amount of the nonglobular fine-particle powder contained is not greater than 25% by weight. As a result of it, the tone reproduction required of the images formed in the present invention cannot be achieved. On the other hand, when the amount is increased beyond 95% by weight the resulting composition deteriorates its coating suitability. Thus, it tends to form an uneven coating.

The color photosensitive material of the present invention can be formed by coating on a reflecting support at least one yellow color-forming silver halide emulsion layer, at least one magenta color-forming silver halide emulsion layer and at least one cyan color-forming silver halide emulsion layer. In general color photographic printing papers, color reproduction based on the subtractive process can be attained by incorporation of color couplers which can produce dyes bearing the complementary color relationship to the individual colors of light to which their corresponding silver halide emulsions are sensitive. In general color photographic printing papers, silver halide emulsion grains to constitute a color-forming layer, if they are made to correspond to the foregoing color-forming layer in the order of description, are sensitized spectrally with a blue-sensitive, green-sensitive or red-sensitive spectrally sensitizing dye respectively, and these spectrally sensitized emulsions can be coated on a support in the above-described order. However, the coating order thereof may be different from the above-cited one. For instance, there is a case such that it is desirable from the standpoint of rapid processing suitability that the light-sensitive layer which comprises silver halide grains having the largest average grain size be arranged as the topmost layer. In another case, it is desirable in view of preservability under exposure to light that the magenta color-forming light-sensitive layer be arranged as the lowest layer.

As for the relationship between a light-sensitive layer and the hue of the color formed therein, the above-described correspondence may be broken in constitutions applicable to the present invention. Specifically, the present photographic material may contain at least one infrared-sensitive silver halide emulsion layer.

For the silver halide emulsion grains applicable to the present invention, silver chloride, silver bromide, silver (iodo) chlorobromide, silver iodobromide or so on can be used. In particular, the emulsion grains constituted of substantially iodide-free silver chlorobromide or silver chloride are preferred in the present invention from the standpoint of reducing the development time. The expression "substantially iodide-free" as used herein means that the allowable iodide content therein is at most 1 mole %, preferably at most 0.2 mole %. On the other hand, in case where heightening the sensitivity under high intensity illumination, the sensitivity to spectral sensitization or the storage stability of a sensitive material is aimed at, silver halide grains having a high chloride content and containing 0.01 to 3 mole % of silver iodide in the surface part thereof, as disclosed in JP-A-03-84545, are used to advantage.

As for the halide composition of each emulsion, each emulsion grain may be different from or the same as every other emulsion grain in halide composition, but it is easy to render emulsion grains uniform in their properties by the use of an emulsion which has the same halide composition among the emulsion grains.

As for the halide distribution inside the silver halide emulsion grains, one may use grains which are uniform throughout in halide composition, that is to say, have a uniform structure; grains which differ in halide composition between the inner part (core) and the core-surrounding part (shell constructed by one or more of a layer), that is to say, have a layer structure; or grains which contain parts differing in halide composition inside or at the surface thereof without taking a layer form (e.g., have a structure such that said parts are situated at edges, corners or faces in a fused condition when they are present at the grain surface); depending on their intended purpose. For the purpose of achieving high sensitivity, it is more advantageous to use grains of either of the latter two types than to use the grains having a uniform structure. Moreover, the grains of latter two types are favored because of their pressure resistance property. When the grains have an non-uniform structure as described above, a boundary between the parts differing in halide composition may have a clear interface, or may be rendered obscure by forming mixed crystals depending on the difference in halide composition. Also, a continuous change in structure may occur in the boundary region.

In photosensitive materials having rapid processing suitability as aimed at by the present invention, it is desirable that silver halide emulsions having a high chloride content, or so-called high silver chloride emulsions, be used. The high silver chloride emulsions used to advantage in the present invention have a chloride content of at least 90 mole %, preferably at least 95 mole %, and more preferably at least 97 mole %.

It is preferable for the foregoing high silver chloride emulsions to have, as described above, a structure such that silver bromide-localized phases are present inside or/and at the surface of the grains with or without taking a layer form. In the localized phases, the bromide content is preferably at least 10 mole %, and more preferably more than 20 mole %. The bromide content in bromide-localized phases can be determined by an X-ray diffraction method or so on (as described, e.g., in the book compiled by Japanese Chemical Society, entitled, if translated into English, "New lectures on experimental chemistry", volume 6 (the theme for which is "Structural Analyses"), published by Maruzen). Such localized phases can be present inside the grains, or at the edges, corners or faces of the grain surface, especially at the corners of each grain in an epitaxially grown condition.

Also, it is effective to further heighten chloride contents in the silver halide emulsions for reduction in the replenishment rate of a development-processing solution. For this purpose, it is desirable that the chloride content be within the range of 90 to 100 mole %. In particular, a silver halide emulsion having a chloride content of 98 to 100 mole %, namely an almost pure silver chloride emulsion, is used to greater advantage.

The average size of the silver halide grains contained in the silver halide emulsions used in the present invention (the grain size herein refers to the diameter of the circle having the same area as the projected area of the grains, and the number average is taken in expressing the grain size) ranges preferably from 0.1 to 2 μm.

As for the distribution of sizes among grains, so-called monodisperse emulsions which have a variation coefficient (the value obtained by dividing the standard deviation of grain size distribution by the average grain size) of at most 20%, desirably at most 15%, and especially at most 10%, are preferred. For the purpose of obtaining a wide latitude, it is advantageous to coat a blend of some monodisperse emulsions differing in average grain size in a single layer, or to coat them separately in multiple layers.

The silver halide grains contained in the photographic emulsions may have a regular crystal form, such as that of a cube, a tetradecahedron or an octahedron; an irregular crystal form, such as that of a sphere, a plate or so on; or a composite form thereof. Also, there may be a mixture of silver halide grains having various crystal forms. It is desirable in the present invention that the proportion of silver halide grains having a regular crystal form as described above to all silver halide grains present in each photographic emulsion be at least 50%, preferably at least 70%, and much preferably at least 90%.

In addition, an emulsion which contains tabular silver halide grains having an average aspect ratio (a ratio of a projected area diameter to a thickness) of at least 5, preferably at least 8, in a proportion of more than 50%, based on the projected area, to the all silver halide grains present therein can be also used to advantage.

The silver chlorobromide or chloride emulsions used in the present invention can be prepared using various methods as descried, e.g., in P. Glafkides, *Chemie et Phisique Phtographique,* Paul Montel, Paris (1967); G. F. Duffin, *Photographic Emulsion Chemistry,* The Focal Press, London (1966); V. L. Zelikman et al., *Making and Coating Photographic Emulsion,* The Focal Press, London (1964); and so on. Specifically, any processes, including an acid process, a neutral process and an ammoniacal process, may be employed. Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

It is desirable for the localized phase or the substrate of the present silver halide grains to contain a foreign metal ion or the complex ion thereof. As for the foreign metals preferred therein, the ions or complexes of Group VIII and Group IIb metals, lead ion and thallium ion are examples thereof. More specifically, these metal ions and complex ions can be used as a combination such that the ion or complex ion of a metal chosen from iridium, rhodium, iron and the like is contained mainly in the localized phase and, on the other hand, in the substrate there is mainly contained an ion or complex ion of a metal chosen from osmium, iridium, rhodium, platinum, ruthenium, palladium, cobalt, nickel, iron and the like. Further, the metal ions contained in the localized phase and the substrate may be different from each other in kind and content. Furthermore, those metal ions and complex ions may be used as a mixture of two or more thereof. In particular, it is preferable that iron and iridium compounds be present in the localized phase.

The foregoing metal ions can be incorporated into the localized phase and/or other parts (e.g., substrate) of the present silver halide grains by adopting a proper means such that compounds capable of providing such metal ions were added to an aqueous gelatin solution as a dispersion medium, an aqueous halide solutions, an aqueous silver salt solution or another aqueous solution during the formation of silver halide grains, or fine silver halide grains previously doped by such metal ions are added to a silver halide grain-forming system and dissolved thereinto.

In order to incorporate metal ions usable in the present invention into emulsion grains, however, the metal ions may be added in any stage of the grain formation, namely before, during or after the grain formation. The suitable time to add metal ions depends on what part of each emulsion grain the metal ions are intended to be contained in.

In general, the silver halide emulsions used in the present invention are sensitized chemically and spectrally.

Chemical sensitization can be effected using sensitization processes utilizing chalcogen sensitizers (e.g., including a sulfur sensitization process represented by the addition of an unstable sulfur compound, a selenium sensitization process using a selenium compound, and a tellurium sensitization process using a tellurium compound), a precious metal sensitization process represented by a gold sensitization process, and a reduction sensitization process, either individually or in a combination of two or more thereof. As for the compounds for chemical sensitization, those disclosed in JP-A-62-215272, from right lower column at page 18 to right upper column at page 22, are used to advantage.

The emulsions used in the present invention are so-called surface latent-image type emulsions, which form a latent image predominantly at the surface of the grains.

The silver halide emulsions used in the present invention can contain a wide variety of compounds or precursors thereof for the purpose of preventing fog or stabilizing photographic functions during production, storage or photographic processing. Specific examples of such compounds, which can be preferably used in the present invention, include those disclosed in the above-cited patent, JP-A-62-215272, from the page 39 to the page 72. In addition, 5-arylamino-1,2,3,4-thiatriazole compounds (which contain at least one electron-withdrawing group in the individual aryl moieties) disclosed in EP-A-0447647 are also used advantageously.

Spectral sensitization is carried out for the purpose of imparting spectral sensitivities in a desired wavelength region of light to an emulsion constituting each light-sensitive layer of the present photographic material.

Examples of spectral sensitizing dyes which can be used for the spectral sensitization of the present photographic material in blue, green and red regions respectively include those described, e.g., in F. M. Harmer, *Heterocyclic compounds -Cyanine dyes and related compounds,* John Wiley & Sons, New York and London (1964). Specific examples of compounds and spectral sensitization processes which can be employed to advantage in the present invention include those disclosed in the above-cited patent, JP-A-62-215272, from right upper column at page 22 to page 38. In particular, the spectral sensitizing dyes disclosed in JP-A-03-123340 are extremely preferred as red-sensitive spectral sensitizing dyes for silver halide emulsion grains having a high chloride content from the viewpoints of stability, adsorption strength, temperature dependence during exposure rand so on.

In order to efficiently impart spectral sensitivities in the infrared region to the photographic material of the invention, there can be preferably used the sensitizing dyes disclosed in JP-A-03-15049, from left upper column at page 12 to left lower column at page 21; JP-A-03-20730, left lower column at page 4 to left lower column at page 15; EP-A-0420011, from 21st line at page 4 to 54th line at page 6; EP-A-0420012, 12th line at page 4 to 33rd line at page 10; EP-A-0443466; and U.S. Pat. No. 4,975,362.

In incorporating a spectral sensitizing dye as cited above into a silver halide emulsion, the sensitizing dye may be dispersed directly into the emulsion, or it may be added to the emulsion in the form of solution prepared by dissolving it into a solvent chosen from water, methanol, ethanol, propanol, methyl cellosolve, 2,2,3,3-tetrafluoropropanol, mixtures of two or more thereof and the like. Prior to the addition thereof to the emulsion, on the other hand, the spectral sensitizing dye may be dissolved into water in the presence of an acid or base, as disclosed in JP-B-44-23389 (the term "JP-B" as used herein means an "examined Japanese patent publication"), JP-B-44-27555, JP-B-57-22089 and so on, or it may be made into an aqueous solution or colloidal dispersion in the presence of a surfactant, as disclosed in U.S. Pat. Nos. 3,822,135 and 4,006,025, and so on. Also, the addition of the sensitizing dye to the emulsion may be carried out in the form of dispersion prepared by dispersing the sensitizing dye previously dissolved in a solvent substantially immiscible with water, such as phenoxyethanol, into water or a hydrophilic colloid. Moreover, as disclosed in JP-A-53-102733 and JP-A-58-105141, the sensitizing dye may be dispersed directly into a hydrophilic colloid, and then added to the emulsion. As for the time to add the sensitizing dye to the emulsion, any stage of emulsion-making may be chosen, provided that it has so far been known as effective in the addition.

Specifically, the addition time can be chosen from the stage prior to the grain formation of silver halide emulsion, the grain formation stage, the period from the conclusion of the grain formation to the start of the washing process, the stage prior to chemical sensitization, the chemical sensitization stage, the period from the conclusion of chemical sensitization to the conclusion of the gelation of the emulsion by cooling, and the preparation stage of the coating composition. Although it is most general to carry out the addition during the period from the conclusion of chemical sensitization to the start of the coating operation, a sensitizing dyes can be added simultaneously with chemical sensitizers to achieve the spectral sensitization and chemical sensitization at the same time, as disclosed in U.S. Pat. Nos. 3,628,969 and 4,225,666, or it can be added in advance of chemical sensitizers as disclosed in JP-A-58-113928, or it can be added before the conclusion of the precipitation of silver halide grains to start spectral sensitization. On the other hand, it is possible to divide a sensitizing dye into some portions and to add them in different stages respectively. For instance, one portion can be added before chemical sensitization and the remainder can be added after chemical sensitization, as taught fry U.S. Pat. No. 4,225,666. Further, as taught by references including U.S. Pat. No. 4,183,756, those portions may be added separately in any stages of the grain formation. However, it is preferred in particular to add a sensitizing dye before the washing or chemical sensitization process of the emulsion.

Although amounts of those spectral sensitizing dyes to be added can be varied over a wide range depending on the purpose, it is desirable for them to range from $0.5\times10^{-6}$ mole to $1.0\times10^{-2}$ mole per mole of silver halide. Preferably, they are within the range of $1.0\times10^{-6}$ mole to $5.0\times10^{-3}$ mole per mole of silver halide.

When sensitizing dyes having their spectral sensitivities at wavelengths extending from the red region to the infrared region are employed in the present invention, it is particularly preferred to use them in combination with the compounds disclosed in JP-A-02-157749, from right lower column at page 13 to right lower column at page 22. The combined use with these compounds can especially heighten the keeping quality of the sensitive material, the processing stability and the supersensitizing effect.

Examples of a support applicable to the present invention include both transparent and reflecting ones. As for the reflecting supports, those having no specular reflectivity and no secondary diffuse reflectance, with specific examples including polyethylene-laminated paper, white pigment-containing plastic films and supports coated with white pigment-containing hydrophilic colloid layers, are used to advantage.

Of the reflecting supports, those preferred in particular are supports such that their substrate is paper and has a waterproof resin layer provided on the same side as the silver halide emulsion layers and filled with a white pigment in a density of at least 14% by weight. The density of a white pigment is preferably not less than 15% by weight, and more preferably not less than 20% by weight.

The waterproof resin layer filled with a fine-grain white pigment, such as titanium dioxide, is provided so as to have a thickness of 3 to 200μm, preferably 5 to 80 μm.

The waterproof resin layer containing a fine-grain white pigment, such as titanium dioxide, may be used together with other waterproof resin layers including those differing in content or species of the white pigment contained therein and white pigment-free waterproof resin layers. In this case, it is desirable that the waterproof resin layer containing a fine-grain white pigment, such as titanium dioxide, be provided farther from the support than any other waterproof resin layer.

The dispersibility of a fine-grain white pigment, such as titanium dioxide, in a waterproof resin layer can be evaluated as follows: The resin molecules present in the layer surface part about 0.1 μm, preferably the order of 0.05 μm, in thickness are made to scatter using an ion sputtering method utilizing glow discharge, and the thus bared fine grains of the pigment are observed under an electron microscope, thereby determining the occupied area rate (%) of the fine grains and the variation coefficient thereof. The thus determined values are used for the evaluation of pigment dispersibility. For the details of the ion sputtering method, there can be referred to, e.g., the paper written by Y. Murayama & K. Kashiwagi, entitled, if translated into English, "The Arts of Plasma-Utilized Surface Treatments", published in *Kikai no Kenkyu* (which means "Machinery Researches"), Vol. 33, No. 6 (1981).

The occupied area rate (%) of a fine-grain white pigment per defined unit area can be determined most typically by dividing the observed area into adjacent unit areas having a size of 6 μm×6 μm, measuring the area occupied by fine grains projected on each unit area, and determining the ratio of an area occupied by the projected fine grains to each unit area (Ri). The variation coefficient of the occupied area rates (%) can be determined as a ratio of the standard deviation of Ri (represented by s) to the mean of Ri's (represented by Rm), that is, s/Rm. The number of unit areas to be examined as subjects (represented by n) is preferably at least 6.

The variation coefficient of the occupied area rates of a fine-grain white pigment is preferably at most 0.20, more preferably at most 0.15, and particularly preferably at most 0.10.

In providing the waterproof resin layer on a support base, there can be adopted lamination methods as described, e.g., in *Shin Laminate Kakoh Binran* (which means "Handbook of New Lamination Processes"), compiled by Kakoh Gijutsu Kenkyu-kai, including a dry lamination method, a solventless type dry lamination method and so on, and coating methods of gravure roll type, wire bar type, doctor blade type, reverse roll type, dipping type, air knife type, calender type, kiss type, squeeze type, fountain type, coating type and so on.

The support is preferably subjected to a corona discharge treatment, a glow discharge treatment, a flame treatment or the like, and then coated with a group of hydrophilic colloid layers to constitute the silver halide photographic material.

It is desirable for the support to have a basis weight of 30 to 350 g/m$^2$, preferably 50 to 200 g/m$^2$.

For details of support matters as described above, JP-A-02-239244 can be referred to.

In order to prevent irradiation and halation phenomena from occurring and to heighten safelight immunity and the like in the photographic materials relating to the present invention, it is desired that the dyes capable of undergoing decoloration during photographic processing (especially oxonol dyes and cyanine dyes) disclosed at pages 27 to 70 in EP-A2-0337490 be added to hydrophilic colloid layers. Also, there can be advantageously used such dyes as to be incorporated into a hydrophilic colloid layer in the form of dispersion of fine solid particles and to be decolored by development-processing, including the dyes disclosed in JP-A-02-282244 (from right upper column at page 3 to page 8) and the dyes disclosed in JP-A-03-7931 (from right upper column at page 3 to left lower column at page 11).

Those water-soluble dyes include those which cause deterioration in color separation and safelight immunity when they are increased in amount added. As for the dyes which can be used without accompanied by deterioration in color separation, the water-soluble dyes disclosed in Japanese Patent Application Nos. 03-310143, 03-310189 and 03-310139 are suitable examples thereof.

It is desirable that the dyes as cited above be used in such an amount as to impart an optical reflection density of at least 0.7 at 680 nm to the resulting photographic material.

In addition, it is favorable to use colloidal silver in an antihalation layer, as disclosed in JP-A-01-239544.

As a binder or a protective colloid for the photographic materials relating to the present invention, gelatin can be used to advantage. Also, hydrophilic colloids other than gelatin can be used alone or together with gelatin. As for the gelatin, gelatins low in calcium content, such as those having a calcium content below 800 ppm, preferably below 200 ppm, are used to greater advantage. Further, it is desirable that the antimolds disclosed in JP-A-63-271247 be added to the present photographic materials in order to prevent the deterioration of images from occurring through propagation of various kinds of molds and bacteria in the hydrophilic colloid layers.

As for the support used in the photographic materials relating to the present invention, a support of the white polyester type or a support provided with a white pigment-containing layer on the same side as the silver halide emulsion layers may be adopted for display use. Further, it is desirable for improving sharpness that an antihalation layer be provided on the emulsion layer side or the reverse side of the support. In particular, it is desired that the transmission density of the support be adjusted to the range of 0.35 to 0.8 so that a display may be enjoyed by means of both transmitted and reflected light.

The photographic materials relating to the present invention may be exposed to either visible or infrared rays of light. For the exposure, not only low intensity exposure but also high intensity exposure may be employed. In case of high intensity exposure, a laser scanning exposure system in which the exposure time per picture element is shorter than $10^{-4}$ second, preferably below $10^{-6}$ second, is favored.

Upon exposure, it is preferable to use the band stop filter disclosed in U.S. Pat. No. 4,880,726. This filter can get rid of color amalgamation of optical origin to improve color reproducibility to a great extent.

Although optically exposed photographic materials can be subjected to conventional operations for color photographic processing, it is preferable for the present photographic materials to undergo a bleach-fix operation after a color development operation because the achievement of rapid processing is aimed at in the present invention. In case the foregoing high silver chloride emulsions are used, it is desired in particular that the pH of a bleach-fix bath be not higher than abut 6.5, preferably below about 6, for the purpose of accelerating the desilvering speed.

Silver halide emulsions, other ingredients (such as additives, etc. ) and photographic constituent layers (including their order of arrangement) which can be suitably used in the present photographic materials, and photographic processing methods and additives for photographic processing which can be preferably employed for processing the present photographic materials are those disclosed in the following patent specifications, especially in EP-A2-0355660 (corresponding to JP-A-02-139544 ).

| Photographic Constituents and Related Matters | JP-A62-215272 | JP-A-02-33144 | EP-A2-0355660 |
|---|---|---|---|
| Silver halide emulsions | page 10, right upper column, line 6 to page 12, left lower column, line 5, and page 12, right lower column, line 4 from the bottom to page 13, left upper column, line 17. | page 28, right upper column line 16 to page 29, right lower column, line 11, and page 30, lines 2 to 5. | page 45, line 53 to page 47, line 3, and page 47, lines 20 to 22. |
| Silver halide solvents | page 12, left lower column, lines 6 to 14, and page 13, left upper column, line 3 from the bottom to page 18, left lower column, end line. | — | — |
| Chemical sensitizers | page 12, left lower column, line 3 from the bottom to right lower column, line 5 from the bottom, and page 18, right lower column, line 1 to page 22, right upper column line 9 from the bottom. | page 29, right lower column, line 12 to end line. | page 47, lines 4 to 9. |
| Spectral sensitizers (including spectral sensitization methods) | page 22, right upper column, line 8 from the bottom to page 38, end line. | page 30, left upper column, lines 1 to 13. | page 47, lines 10 to 15. |
| Emulsion stabilizers | page 39, left upper column, line 1 to page 72, right upper column, end line. | page 30, left upper column, line 14 to right upper column, line 1. | page 47, lines 16 to 19. |
| Development accelerators | page 72, left lower column, line 1 to page 91, right upper column, line 3. | — | — |
| Color couplers | page 91, right upper column, | page 3, right upper column, | page 4, lines 15 to 27, |

-continued

| Photographic Constituents and Related Matters | JP-A62-215272 | JP-A-02-33144 | EP-A2-0355660 |
|---|---|---|---|
| (cyan, magenta and yellow couplers) | line 4 to page 121, left upper column, line 6. | line 14 to page 18, left upper column, end line, and page 30, right upper column, line 6 to page 35, right lower column, line 11. | page 5, lines 30 to page 28, end line, page 45, lines 29 to 31, and page 47, line 23 to page 63, line 50. |
| Color formation reinforcing agent | page 121, left upper column, line 7 to page 125, right upper column, line 1. | — | — |
| Ultraviolet absorbents | page 125, right upper column, line 2 to page 127, left lower column, end line. | page 37, right lower column, line 14 to page 38, left upper column, line 11. | page 65, lines 22 to 31. |
| Discoloration inhibitors (image stabilizers) | page 127, right lower column, line 1 to page 137, left lower column, line 8. | page 36, right lower column, line 12 to page 37, left lower column, line 19. | page 4, line 30 to page 5, line 23, page 29, line 1 to page 45, line 25, page 45, line 33 to 40, and page 65, lines 2 to 21. |
| High boiling and/or low boiling organic solvents | page 137, left lower column, line 9 to page 144, right upper column, end line. | page 35, right lower column, line 14 to page 36, left upper column, line 4 from the bottom. | page 64, lines 1 to 51. |
| Dispersion methods for photographic additives | page 144, left lower column, line 1 to page 146, right upper column, line 7. | page 27, right lower column, line 10 to page 28, left upper column, end line, and page 35, right lower column, line 12 to page 36, right upper column, line 7. | page 63, line 51 to page 64, line 56. |
| Hardeners | page 146, right upper column, line 8 to page 155, left lower column, line 4. | — | — |
| Precursors of developing agent | page 155, left lower column, line 5 to right lower column, line 2. | — | — |
| Development inhibitor releasing compounds | page 155, right lower column, lines 3 to 9. | — | — |
| Supports | page 155, right lower column, line 19 to page 156, left upper column, line 14. | page 38, right upper column, line 18 to page 39, left upper column, line 3. | page 66, line 29 to page 67, line 13. |
| Light-sensitive layer constitution | page 156, left upper column, line 15 to right lower column, line 14. | page 28, right upper column, lines 1 to 15. | page 45, lines 41 to 52. at page 45 |
| Dyes | page 156, right lower column, line 15 to page 184, right lower column, end line. | page 38, left upper column, line 12 to right upper column, line 7. | page 66, lines 18 to 22. |
| Color stain inhibitors | page 185, left upper column, line 1 to page 188, right lower column, line 3. | page 36, right upper column, lines 8 to 11. | page 64, line 57 to page 65, line 1. |
| Tone modifiers | page 188, right lower column, lines 4 to 8. | — | — |
| Stain inhibitors | page 188, right lower column, line 9 to page 193, right lower column, line 10. | page 37, left upper column, end line to right lower column, line 13. | page 65, line 32 to page 66, line 17. |
| Surfactants | page 201, left lower column, line 1 to page 210, right upper column, end line. | page 18, right upper column, line 1 to page 24, right lower column, end line, and page 27, left lower column, line 10 from the bottom to right lower column, line 9. | — |
| Fluorine-containing compounds (antistatic agent, coating aids, lubricants, adhesion inhibitors, etc.) | page 210, left lower column, line 1 to page 222, left lower column, line 5. | page 25, left upper column, line 1 to page 27, right lower column, line 9. | — |
| Binders (hydrophilic colloids) | page 222, left lower column, line 6 to page 225, left upper column, end line. | page 38, right upper column, lines 8 to 18. | page 66, lines 23 to 28. |
| Thickening agent | page 225, right upper column, line 1 to page 227, right upper column, line 2. | — | — |
| Antistatic agent | page 227, right upper column, line 3 to page 230, left upper column, line 1. | — | — |
| Polymer latexes | page 230, left upper column, line 2 to page 239, end line. | — | — |
| Matting agent | page 240, left upper column, line 1 to right upper column, end line. | — | — |
| Photographic processing methods (including processing steps, | page 3, right upper column, line 7 to page 10, right upper column, line 5. | page 39, left upper column, line 4 to page 42, left upper column, end line. | page 67, line 14 to page 69, line 28. |

-continued

| Photographic Constituents and Related Matters | JP-A62-215272 | JP-A-02-33144 | EP-A2-0355660 |
|---|---|---|---|
| additives, and so on) | | | |

Note) The quoted paragraphs of JP-A-62-21527 are intended to include the contents of amendments dated March 16 in 1987 which were given in the end of the bulletin.

In addition to the above-cited color couplers, the so-called blue-shift yellow couplers disclosed in JP-A-63-231451, JP-A-63-123047, JP-A-63-241547, JP-A-01-173499, JP-A-01-213648 and JP-A-01-250944 can be used to advantage.

As for the incorporation of a cyan, magenta or yellow coupler, it is desirable that a loadable latex polymer (as disclosed, e.g., in U.S. Pat. No. 4,203,716) impregnated with the coupler in the presence or absence of a high boiling organic solvent as described in the above table, or the coupler dissolved in a high boiling organic solvent together with a polymer insoluble in water but soluble in an organic solvent, be dispersed into a hydrophilic colloid solution in an emulsified condition.

Water-insoluble, organic solvent-soluble polymers which can preferably used therein include the homo- or copolymers disclosed in U.S. Pat. No. 4,857,449, from column 7 to column 15, and WO 88/00723, from page 12 to page 30. Much preferably, polymers of methacrylate or acrylamide type, especially those of acrylamide type, are favored over others with respect to color image stabilization and so on.

In addition, it is desirable that the compounds for improving the keeping quality of color images as disclosed in EP-A2-0277589 be used together with the couplers in the present photographic materials. In particular, the combined use of such compounds and couplers of pyrazoloazole or pyrrolotriazole type is advantageous.

More specifically, the compounds having a property such that they can produce chemically inert, substantially colorless compounds by combining chemically with an aromatic amine developing agent remaining after the color development-processing, which are disclosed in the above-cited patent specifications, and/or the compounds having a property such that they can produce chemically inert, substantially colorless compounds by combining chemically with the oxidized aromatic amine developing agent remaining after the color development-processing, which are also disclosed in the above-cited specifications, are preferably used in combination or independently. By the use of these compounds, the generation of stains, which are due to the formation of dyes through the reaction between the couplers and the unoxidized or oxidized color developing agent remaining in the processed photographic film, and other side reactions upon storage after photographic processing, can be inhibited effectively.

As for the cyan couplers, not only the diphenylimidazole type cyan couplers disclosed in JP-A-02-33144, but also the 3-hydroxypyridine type cyan couplers disclosed in EP-A2-0333185 (especially one which is preparedly introducing a chlorine atom as a splitting-off group into Coupler (42) cited as a specific example to render the coupler two-equivalent, and Couplers (6) and (9) cited as specific examples), the cyclic active methylene type cyan couplers disclosed in JP-A-64-32260 (especially Couplers 3, 8 and 34 cited as specific examples), the pyrrolopyrazole type cyan couplers disclosed in EP-A1-0456226, the pyrroloimidazole type cyan couplers disclosed in EP-0484909 and the pyrrolotriazole type cyan couplers disclosed in EP-0488248 and EP-A1-0491197, are preferably used. In particular, the pyrrolotriazole type cyan couplers are favored other overs.

As for the yellow couplers, not only those described in the above table but also the acylacetamide type yellow couplers whose acyl moiety contains a 3- to 5-membered cyclic structure, which are disclosed in EP-A1-0447969, the cyclic structure-containing malonic acid dianilide type yellow couplers disclosed in EP-A1-0482552 and the dioxane structure-containing acylacetamide type yellow couplers disclosed in U.S. Pat. No. 5,118,599 are preferably used. Of these couplers, the acylacetamide type yellow couplers whose acyl moiety is a 1-alkylcyclopropane-1-carbonyl group and the malonic acid dianilide type yellow couplers one anilide moiety of which constitutes an indoline ring are preferred in particular. These couplers can be used alone or in combination.

As for the magenta couplers, 5-pyrazolone type and pyrazoloazole type magenta couplers as disclosed in the references of the above table can be used in the present invention also. Of those couplers, the pyrazolotriazole couplers which have a secondary or tertiary alkyl group attached directly to the 2-, 3- or 6-position of their respective pyrazolotriazole ring, as disclosed in JP-A-61-65245, the sulfonamido group-containing pyrazolotriazole couplers disclosed in JP-A-61-65246, the pyrazoloazole couplers which contain an alkoxyphenylsulfonamido group as a ballast group, as disclosed in JP-A-61-147254, and the pyrazoloazole couplers which have an alkoxy or aryloxy group at the 6-position, as disclosed in EP-A-0226849 and EP-A-0294785, are favored over others in view of hue, image stability, color formability and so on.

In processing the present silver halide color photographic materials, the ingredients for processing solutions and the processing methods disclosed in JP-A-02-207250, from 1st line in right lower column at page 26 to 9th line in right upper column at page 34, and JP-A-04-97355, from 17th line in left upper column at page 5 to 20th line in right lower column at page 18, are preferably employed as well as those described in the above table.

The present invention will now be described in more detail by way of the following examples. However, the invention should not be construed as being limited to these examples.

EXAMPLE 1

Preparation of Emulsion

To a solution prepared by adding 32 g of lime-processed gelatin to 800 ml of distilled water and then warming them to 40° C., 5.8 g of sodium chloride was added and 1.9 ml of N,N'-dimethylimidazolidine-2-thione (1% water solution) were added, and heated up to 72° C. Thereto, a water solution containing 80 g of silver nitrate in 480 ml of distilled water and a water solution containing 27.6 g of sodium chloride in 480 ml of distilled water were added over a 60-minute period with stirring at 72° C. Further, a water solution containing 80 g of silver nitrate in 300 ml of distilled water and a water solution containing 24.3 g of sodium chloride in 300 ml of distilled water were added thereto over a 20-minute period with stirring at 72° C. After desalting and washing treatments was carried out at 40° C., the emulsion obtained was admixed with 90 g of lime-processed gelatin, and adjusted to pH 6.4 and pAg 7.4 using sodium chloride and sodium hydroxide. Moreover, 4 mg of heaxacyanoferrate(II) trihydrate was added to the emulsion during the grain formation. After the emulsion was warmed to 50° C., a water solution of potassium bride was added thereto in an amount required for increasing the silver bromide content in the emulsion by 0.4 mole %, thereby forming a bromide-localized phase in the emulsion grain surface. Thereafter, it was further admixed with $1\times 10^{-5}$ mole/mole Ag of triethyl thiourea and $5\times 10^{-6}$ mole/mole Ag of chloroauric acid so as to achieve the optimum gold-sulfur sensitization. Furthermore, the emulsion was subjected to spectral sensitization using the blue-sensitive sensitizing dyes illustrated hereinafter. The thus obtained silver chlorobromide emulsion having a chloride content of 99.6mole % was named Emulsion $\gamma-1$.

Other emulsions having a chloride content of 99.6mole %, named Emulsions G1, G2, C1 and C2, were prepared in the same manner as Emulsion$\gamma-1$, except that the reaction temperature was changed variously so that their respective grain sizes might be intended ones. Further in the former two emulsions were used green-sensitive sensitizing dyes instead of the blue-sensitive sensitizing dyes, while a red-sensitive sensitizing dye was used instead of the blue-sensitive ones in the latter two emulsions.

A multilayer color photographic paper was prepared using these silver halide emulsions in the following process.

A support used was a paper support on both sides of which a polyethylene laminate had been provided using the method shown in the example of JP-A-03-156439, and contained 14 wt % of titanium dioxide in the polyethylene laminate on which the silver halide emulsion layers were to be coated. The surface of this support was subjected to corona discharge, and then provided with a gelatin subbing layer in which sodium dodecylbenzenesulfonate was incorporated. Thereon, various constituent layers described below were further coated to prepare a multilayer color photographic paper (Sample No. 101). Coating solutions used therein were prepared in the following manners.

Preparation of coating Solution for First Layer

A yellow coupler (ExY) in an amount of 153.0 g, 15.0 g of a color image stabilizer (Cpd-1), 7.5 g of a color image stabilizer (Cpd-2) and a color image stabilizer (Cpd-3) were dissolved in a mixture of 25 g of a solvent (Solv-1), 25 g of a solvent (Solv-2) and 180 ml of ethyl acetate, and then dispersed into 1,000 ml of a 10% aqueous gelatin solution containing 60 ml of a 10% aqueous solution of sodium dodecylbenzenesulfonate and 10 g of citric acid in an emulsified condition, thereby preparing Emulsified Dispersion A.

Further, the silver chlorobromide emulsion prepared in the above-described mariner (Emulsion $\gamma$-1) and the foregoing Emulsified Dispersion A were mixed homogeneously, and thereto were added other ingredients described below so as to obtain the coating solution for the first layer having the composition described below.

Coating solutions for the second to the seventh layer were prepared in a similar manner to that for the first layer. In each layer, sodium salt of 1-oxy-3,5-dichloro-s-triazine was used as gelatin hardener.

In addition, the following compounds (Cpd-15) and (Cpd-16) were added to all of the coating solutions so as to have the total coverages of 25.0 mg/m$^2$ and 50.0 mg/m$^2$, respectively.

The spectral sensitizing dyes used in their individual silver halide chlorobromide emulsions for the light-sensitive emulsion layers were illustrated below:

Blue-Sensitive Emulsion Layer

Sensitizing Dye A

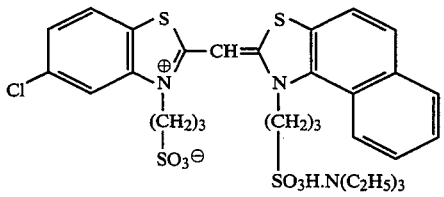

and

Sensitizing Dye B

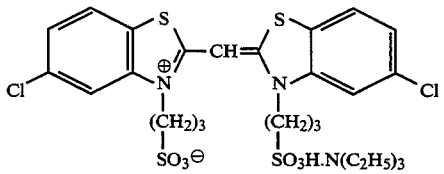

(each of which was added to the emulsion in the amount of $2.0\times 10^{-4}$ mole/mole Ag)

Green-Sensitive Emulsion Layer

Sensitizing Dye C

-continued

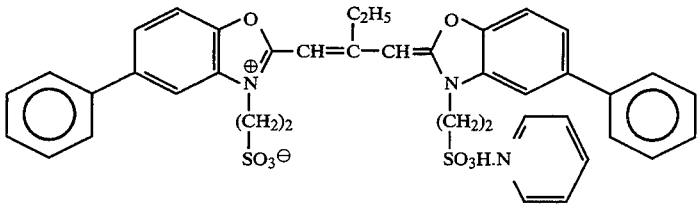

(which was added to the large-sized emulsion in the amount of $4.0 \times 10^{-4}$ mole/mole Ag and to the small-sized emulsion in the amount of $5.6 \times 10^{-4}$ mole/mole Ag)

Sensitizing Dye D

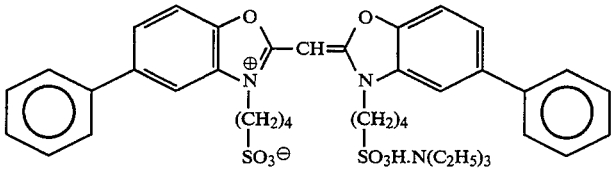

(which was added to the large-sized emulsion in the amount of $7.0 \times 10^{-5}$ mole/mole Ag and to the small-sized emulsion in the amount of $1.0 \times 10^{-4}$ mole/mole Ag)

Red-Sensitive Emulsion Layer

Sensitizing Dye E

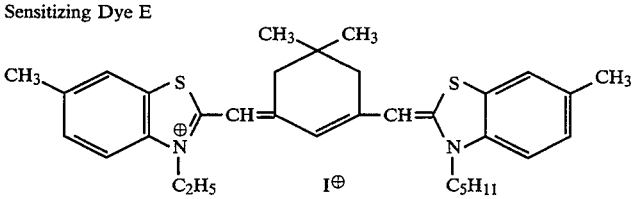

(which was added to the large-sized emulsion in the amount of $0.9 \times 10^{-4}$ mole/mole Ag and to the small-sized emulsion in the amount of $1.4 \times 10^{-4}$ mole/mole Ag)

Compound F

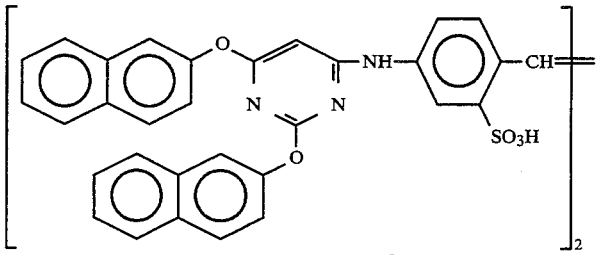

(which was added in the amount of $2.6 \times 10^{-3}$ mole/mole Ag)

Further, 1-(5-methylureidophenyl )-5-mercaptotetrazole was incorporated into the blue-sensitive, the green-sensitive and the red-sensitive emulsion layers in the amounts of $3.4 \times 10^{-4}$ mole/mole Ag, $9.7 \times 10^{-4}$ mole/mole Ag and $5.5 \times 10^{-4}$ mole/mole Ag, respectively.

Furthermore, 4-hydroxy- 6 -methyl -1,3,3*a*,7-tetrazaindene was incorporated into the blue-sensitive and the green-sensitive emulsion layers in the amounts of $1 \times 10^{-4}$ mole/mole Ag and $2 \times 10^{-4}$ mole/mole Ag, respectively.

Layer Structure and Compositions of Constituent Layers Thereof

The composition of each constituent layer is described below. Each figure on the right side represents a coverage (g/m$^2$) of the ingredient corresponding thereto. As for the silver halide emulsion, the figure represents a coverage based on silver.

| | |
|---|---|
| Support | |
| Polyethylene-laminated paper center plane average rouhness : $SR_A = 0.12$ μm) containing white pigment ($TiO_2$ conatent: 14 wt %) and a bluish dye (ultramarine) in the polyethylene laminate on the side of the first layer | |
| First layer (blue-sensitive eulsion layer) | |
| Silver chlorde emulsion [having a bromide cot of 0.4 mole %, a cubic crystal shape, an average grain size of 0.70 μm and a variation coefficient of 0.8 with respect to size distribution] | 0.27 |
| Gelatin | 1.36 |
| Yellow Coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second Layer (color aalgamation inhibiting layer) | |
| Gelatin | 0.99 |

-continued

| | |
|---|---|
| Color amalgaation inhibitor (Cpd-4) | 0.08 |
| Solvent (Solv-2) | 0.25 |
| Solvent (Solv-3) | 0.25 |
| Third layer (green-sensitive emulsion layer) | |
| Silver chlorobromide emulsion [6:4 (by mole based on Ag) mixture of a large-sized Emulsion G1 having a cubic crystal shape, an average grain size of 0.55 μm and a variation coefficient of 0.10 with respect to size distribution and a small-sized Emulsion G2 having a cubic crystal shape, an average grain size of 0.39 μm and a variation coefficient of 0.08 with respect to size distribution, which both contained 0.4 mol % of AgBr localized in part of the grain surface] | 0.13 |
| Gelatin | 1.45 |
| Mageta coupler (ExM) | 0.16 |
| Color image stabilizer (Cpd-6) | 0.15 |
| Color image stabilizer (Cpd-2) | 0.03 |
| Color image stabilizer (Cpd-7) | 0.01 |
| Color image stabilizer (Cpd-8) | 0.01 |
| Color image stabilizer (Cpd-9) | 0.08 |
| Solvent (Solv-3) | 0.50 |
| Solvent (Solv-4) | 0.15 |
| Solvent (Solv-5) | 0.15 |
| Fourth layer (color amalgamation inhibiting layer) | |
| Gelatin | 0.70 |
| Color amalgaaion inhibitor (Cpd-4) | 0.04 |
| Color image stabilizer (Cpd-5) | 0.02 |
| Solvent (Solv-2) | 0.18 |
| Solvent (Solv-3) | 0.18 |
| Fifth layer (red-sensitive emulsion layer) | |
| Silver chlorobromide emulsion [1:4 (by mole based on Ag) mixture of a large-sized Emulsion C1 having a cubic crystal shape, an average grain size of 0.58 μm and a variation coefficient of 0.09 with respect to size distribution and a small-sized Emulsion C2 havLng a cubic crystal shape, an average grain size of 0.45 μm and a variation coefficient of 0.11 with respect to size distribution, which both contained 0.4 mol % of AgBr localized in part of the grain surface] | 0.20 |
| Gelatin | 0.85 |
| Cyan coupler (ExC) | 0.33 |
| Ultraviolet asorbant (UV-2) | 0.18 |
| Color image stabilizer (Cpd-1) | 0.33 |
| Color image stabilizer (Cpd-10) | 0.01 |
| Color image stabilizer (Cpd-11) | 0.01 |
| Color image stabilizer (Cpd-12) | 0.01 |
| Color image stabilizer (Cpd-9) | 0.01 |
| Color image stabilizer (Cpd-8) | 0.01 |
| Solvent (Solv-6) | 0.22 |
| Solvent (Solv-1) | 0.01 |
| Sixth layer (ultraviolet absorbing layer) | |
| Gelatin | 0.55 |
| Ultraviolet absorbent (UV-1) | 0.40 |
| Color image stabilizer (Cpd-13) | 0.15 |
| Color image stabilizer (Cpd-6) | 0.02 |
| Seventh layer (protective layer) | |
| Gelatin | 1.13 |
| Acryl-modified polyvinyl alcohol copolymer (modification degree: 17%) | 0.15 |
| Liquid paraffin | 0.03 |
| Color image stabilizer (Cpd-14) | 0.01 |

The structural formulae of the compounds used herein are illustrated below:

(ExY) Yellow Coupler

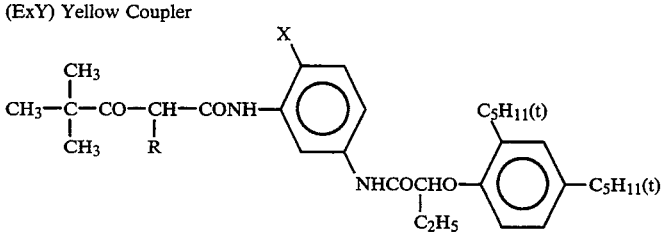

1:1 (by mole) mixture of those containing

R = 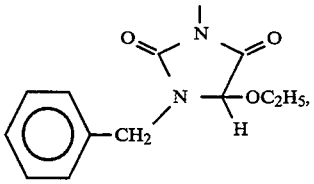 X = Cl and R = 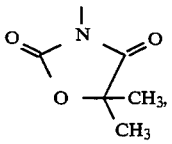 X = $OCH_3$ (ExM) Magenta Coupler

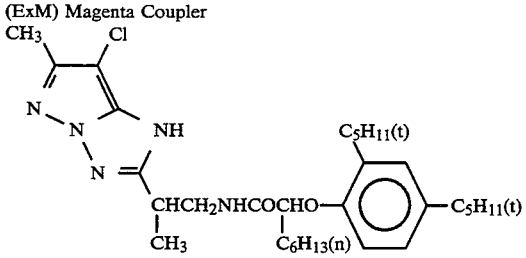

(ExC) Cyan coupler

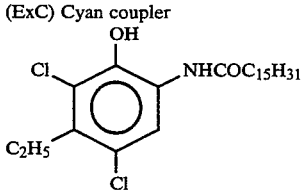

-continued
(Cpd-1) Color image stabilizer
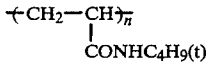
average molecular weight: 60,000
(Cpd-2) Color image stabilizer
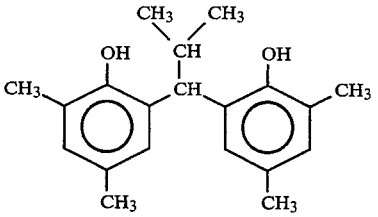
(Cpd-3) Color image stabilizer
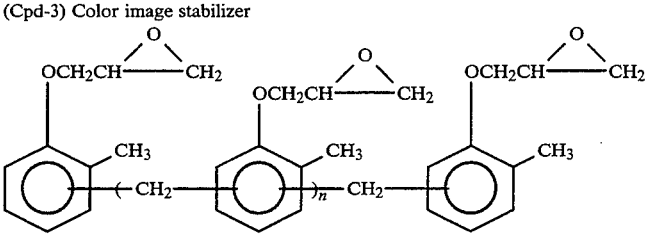
n = 7-8 (on average)
(Cpd-4) Color amalgamation inhibitor
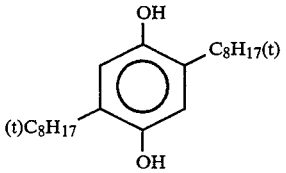
(Cpd-5) Color image stabilizer
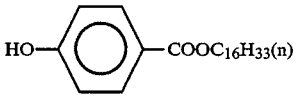
(Cpd-6) Color image stabilizer
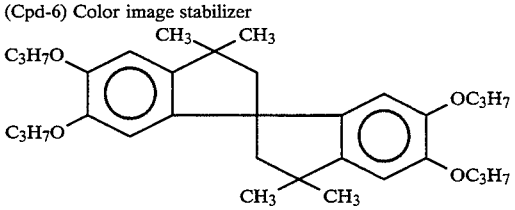
(Cpd-7) Color image stabilizer
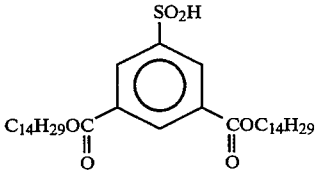
(Cpd-8) Color image stabilizer
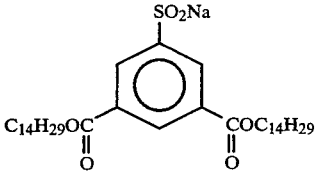
(Cpd-9) Color image stabilizer -continued
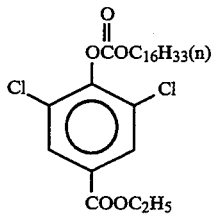
(Cpd-10) Color image stabilizer
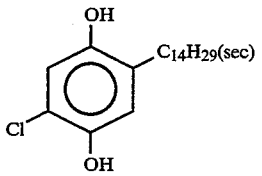
(Cpd-11) Color image stabilizer
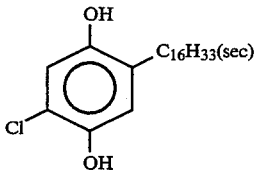
(Cpd-12) Color image stabilizer
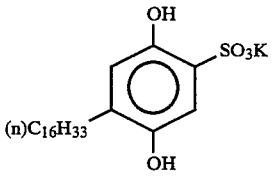
(Cpd-13) Color image stabilizer)
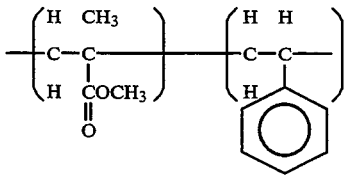
average molecular weight: 60,000
(Cpd-14) Color image stabilizer
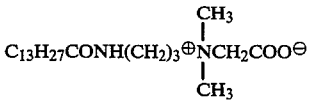
(Cpd-15) Antiseptic
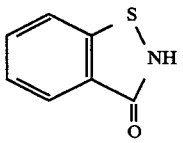
(Cpd-16) Antiseptic
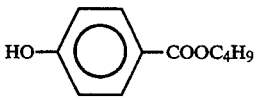
(UV-1) Ultraviolet absorbent
1:5:10:5 (by weight) mixture of (i), (ii), (iii) and (iv):

-continued
(i)
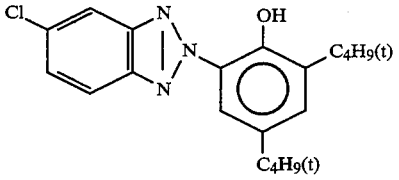
(ii)
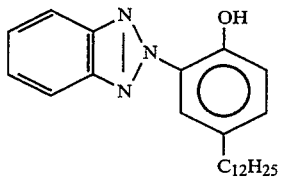
(iii)
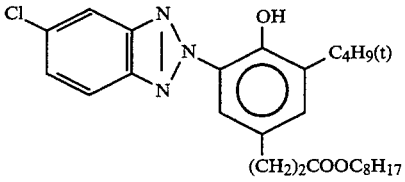
(iv)
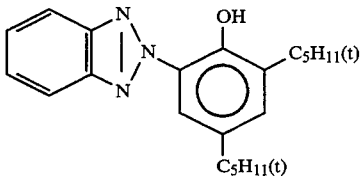
(UV-2) Ultraviolet absorbent
1:2:2 (by weight) mixture of (v), (vi) and (vii):
(v)
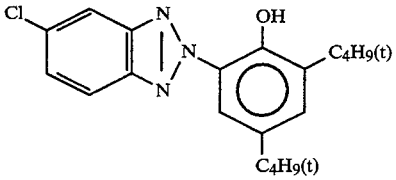
(vi)
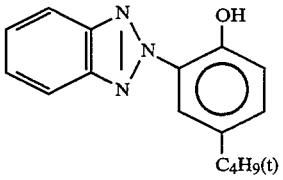
(vii)
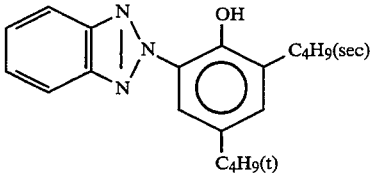
(Solv-1) Solvent
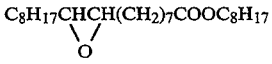
(Solv-2) Solvent
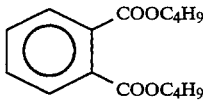
(Solv-3) Solvent
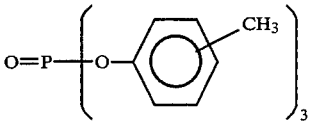
(Solv-4) Solvent
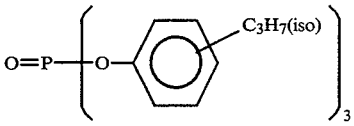
(Solv-5) Solvent
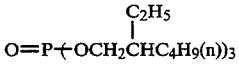
(Solv-6) Solvent -continued

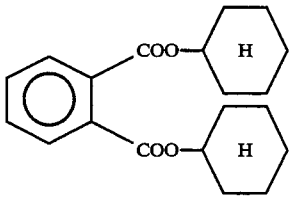

The thus prepared photographic material (Sample No. 101) was adopted as standard, and fine-particle powders as cited hereinbefore were each incorporated into the 7th layer thereof (the protective layer) to prepare other samples (Sample Nos. 102 to 115). The details of the fine-particle powders used (in regard to the species, shape and content (expressed in wt %) thereof) are set forth in Table I. In determining the shape of every fine-particle powder used, the coating solution for the 7th or/and 6th layer were observed under an optical microscope.

Prints were made by printing an actual negative film (with figure and landscape images) onto the thus obtained photographic materials of 15 kinds respectively and then subjecting the resulting materials to photographic processing described below, and examined for tone reproduction in the prints, dependence of the prints upon viewing light-source positions, presence of a massive feeling in the prints and so on to make sensory evaluation of the prints according to the following criterion.

Criterion of Sensory Evaluation

X - - - A gloss and a look (or a feeling) of the images in a print are undesirable depending upon the positions of viewing light sources, and the print as a whole gives a feeling of low-grade quality to a viewer. That is, the print fails in achieving desirable surface gloss and tone reproduction.

Δ- - - The dependence of a gloss and a look (or a feeling) of the images in a print upon the positions of viewing light, sources is improved, but delicate tone reproduction in the figure image and a massive feeling of the landscape image are not in a satisfactory level, so that the print as a whole gives an unsatisfied feeling.

- - - The images in a print are almost satisfactory in all the respects described above.

⊙- - - The images in a print are wholly satisfactory in all the respects described above, so that they can give a highest feeling of quality as color print.

Photographic Processing

The optically exposed samples underwent a photographic processing operation consisting of the following steps using a paper processing machine after the machine was operated so as to attain a stationary processing condition (running operation) by performing continuously the photographic processing operation till the total amount of the replenisher used for color development became twice the volume of a color developing tank used.

| Processing Step | Temperature | Time | Amount replenished* | Tank Volume |
|---|---|---|---|---|
| Color Development | 35° C. | 45 sec. | 161 ml | 17 l |
| Bleach-Fix | 30–35° C. | 45 sec. | 215 ml | 17 l |
| Rinsing (I) | 30–35° C. | 20 sec. | — | 10 l |
| Rinsing (J) | 30–35° C. | 20 sec. | — | 10 l |
| Rinsing (K) | 30–35° C. | 20 sec. | 350 ml | 10 l |
| Drying | 70–80° C. | 60 sec. | | |

*per $m^2$ of photographic material.

(The rinsing was carried out according to the 3-stage counter-current process from the step (K) to the step (I).)

The composition of each processing solution used was described below.

| Color Developer: | Tank Soln | Replenisher |
|---|---|---|
| Water | 800 ml | 800 ml |
| Ethylenediamie-N,N,N',N'-tetramethylene-phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxythyl)hdrazine | 4.0 g | 5.0 g |
| Monosodium N,N-di(sulfoethyl) hydroxylamine | 4.0 g | 5.0 g |
| Brightening agent (WHITEX 4B, products of Sumitomo Chemical Industry Co., Ltd.) | 1.0 g | 2.0 g |
| Water to make | 1000 ml | 1000 ml |
| pH (25° C.) adjusted to | 10.05 | 10.45 |
| Bleach-Fix Bath (Tank Solution = Replenisher): | | |
| Water | 400 ml | |
| Ammonium thiosulfate (70 g/l) | 100 ml | |
| Sodium sulfite | 17 g | |
| Ammonium ethylenediaminetetraacetonato-ferrate(III) | 55 g | |
| Disodium ethylenediaminetetraacetate | 5 g | |
| Ammonium bromide | 40 g | |
| Water to make | 1000 ml | |
| pH (25° C.) adjusted to | 6.0 | |

Rinsing Solution (Tank solution=Replenisher)

Ion exchange water (concentrations of calcium and magnesium each were below 3 ppm).

The results obtained are shown in Table I.

TABLE I

| Sample No. | Species of Fine-particle Powder 6th layer | Species of Fine-particle Powder 7th layer | Shape of Fine-particle Powder 6th layer | Shape of Fine-particle Powder 7th layer | Content (wt %) of Fine-particle Powder in Protective Layer | Sensory Evaluation | Note |
|---|---|---|---|---|---|---|---|
| 101 | — | — | — | — | — | X | comparison |
| 102 | — | silica | — | globular | 25 (in 7th layer) | X | comparison |
| 103 | — | silica | — | globular | 50 (in 7th layer) | Δ | comparison |
| 104 | silica | — | globular | — | 50 (in 6th layer) | Δ | comparison |
| 105 | — | silica | — | nonglobular | 10 (in 7th layer) | Δ | comparison |
| 106 | — | silica | — | nonglobular | 20 (in 7th layer) | Δ | comparison |
| 107 | — | silica | — | nonglobular | 25 (in 7th layer) | ○ | invention |
| 108 | — | silica | — | nonglobular | 35 (in 7th layer) | ○ | invention |
| 109 | — | silica | — | nonglobular | 50 (in 7th layer) | ◎ | invention |
| 110 | silica | — | nonglobular | — | 50 (in 6th layer) | ◎ | invention |
| 111 | — | silica | — | nonglobular | 75 (in 7th layer) | ◎ | invention |
| 112 | — | silica | — | nonglobular | 85 (in 7th layer) | ◎ | invention |
| 113 | — | titania | — | nonglobular | 50 (in 7th layer) | ◎ | invention |
| 114 | — | alumina | — | nonglobular | 50 (in 7th layer) | ◎ | invention |
| 115 | calcium carbonate | silica | nonglobular | nonglobular | 30 (in 6th layer)<br>50 (in 7th layer) | ◎ | invention |

The advantages of the present invention were amply proved by the data set forth in Table I. More specifically, when the particle shape of the fine-particle powder used was globular, such as in Sample Nos. 102 and 103, tone reproduction in the images was unsatisfactory and a look (a feeling) of the images became undesirable depending on the positions of viewing light sources, that is, the use of fine particles having a globular shape failed to achieve the object of the present invention. On the other hand, even using the fine-particle powder having a nonglobular shape, as in Sample Nos. 105 and 106, didn't fully achieve the effects of the present invention, provided that the content of the fine-particle powder in the 7th layer was less than 25% by weight. That is, only when the light-insensitive hydrophilic layer containing nonglobular fine-particle powder in a content of at least 25% by weight was present in a silver halide color photographic material, the photographic material was able to fully achieve the effects of the present invention, namely, excellent tone reproduction in the images, reduced dependence of image quality upon the positions of viewing light sources and a much feeling of massiveness in the images.

EXAMPLE 2

Sample Nos. 201 to 213, distinctive features of which are shown in Table II, were prepared in the same manner as in Example 1, except that the constituents of each layer shown in Example 1 were changed as follows:

| | |
|---|---|
| Support | |
| Polyethylene-laminated paper (center plane average roughness $SR_A$ = 0.120 μm) containing white pigment ($TiO_2$ conatent: 14 wt %) and a bluish dye (ultramarine.) in the polyethylene laminate on the side of the first layer | |
| First layer (blue-sensitive emulsion layer) | |
| Silver chlorobromide emulsion (the same as that of the 1st layer in Example 1) | 0.30 |
| Gelatin | 1.22 |
| Yellow Coupler (EY-2) | 0.55 |
| Color image stabilizer (Cpd-1) | 0.06 |
| Color image stabilizer (Cpd-17) | 0.19 |
| Solvent (Solv-8) | 0.18 |
| Solvent (Solv-1) | 0.18 |

-continued

| | |
|---|---|
| Second Layer (color amalgamation inhibiting layer) | |
| Gelatin | 0.64 |
| Color amalgamation inhibitor (Cpd-4) | 0.10 |
| Solvent (Solv-2) | 0.16 |
| Solvent (Solv-3) | 0.08 |
| Third layer (green-sensitive emulsion layer) | |
| Silver chlorobromide emulsion (the same as that of the 3rd layer in Example 1) | 0.10 |
| Gelatin | 0.28 |
| Magenta coupler (ExM) | 0.23 |
| Color image stabilizer (Cpd-9) | 0.03 |
| Color image stabilizer (Cpd-6) | 0.16 |
| Color image stabilizer (Cpd-18) | 0.02 |
| Color image stabilizer (Cpd-2) | 0.02 |
| Solvent (Solv-7) | 0.40 |
| Fourth layer (ultraviolet absorbing layer) | |
| Gelatin | 1.41 |
| Ultraviolet absorbent (UV-3) | 0.47 |
| Color amalgamation inhibitor (Cpd-4) | 0.05 |
| Solvent (Solv-9) | 0.24 |
| Fifth layer (red-sensitive emulsion layer) | |
| Silver chlorobromide emulsion (the same as that of the 5th layer in Example 1) | 0.20 |
| Gelatin | 0.04 |
| Cyan coupler (ExC-2) | 0.31 |
| Color image stabilizer (Cpd-9) | 0.03 |
| Color image stabilizer (Cpd-18) | 0.02 |
| Color image stabilizer (Cpd-19) | 0.18 |
| Color image stabilizer (Cpd-2) | 0.05 |
| Solvent (Solv-10) | 0.10 |
| Sixth layer (ultraviolet absorbing layer) | |
| Gelatin | 0.48 |
| Ultraviolet absorbent (UV-3) | 0.16 |
| Color amalgamation inhiitor (Cpd-4) | 0.02 |
| Solvent (Solv-9) | 0.08 |
| Fine-particle powder shown in Table II | See Table II |
| Seventh layer (protective layer) | |
| Gelatin | 1.10 |
| Acryl-modified polyvinyl alcohol copolymer (modification degree: 17%) | 0.17 |
| Liquid paraffin | 0.03 |
| Fine-particle powder shown in Table II | See Table II |

The structural formulae of the compounds used herein are illustrated below:

(ExY-2) Yellow coupler
1:1 mixture of (1) and (2):

-continued
(1)
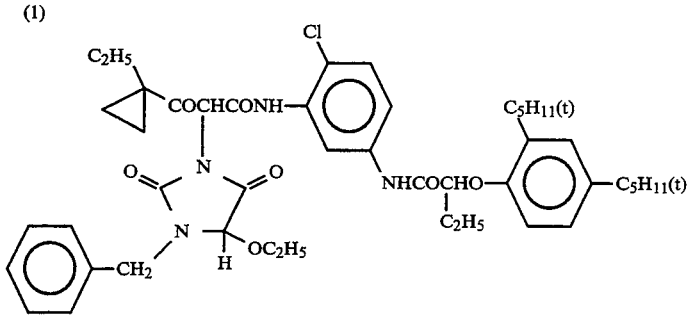
and (2)
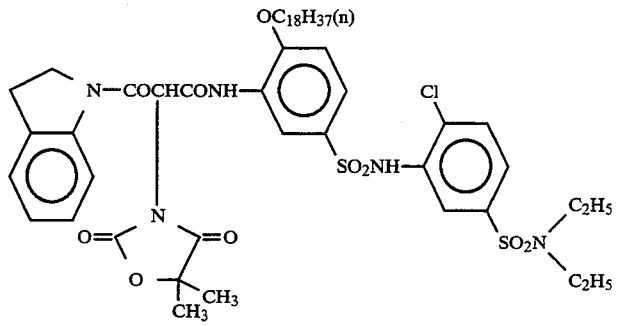
(ExC-2) Cyan coupler
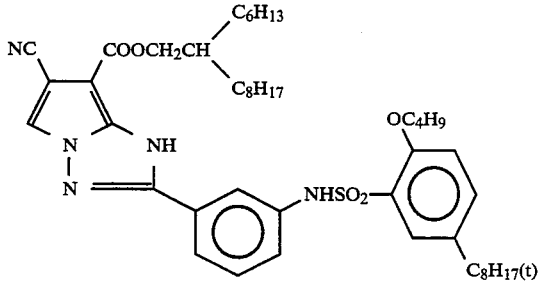
(Cpd-17) Color image stabilizer
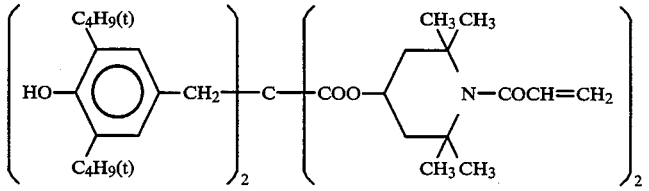
(Cpd-18) Color image stabilizer
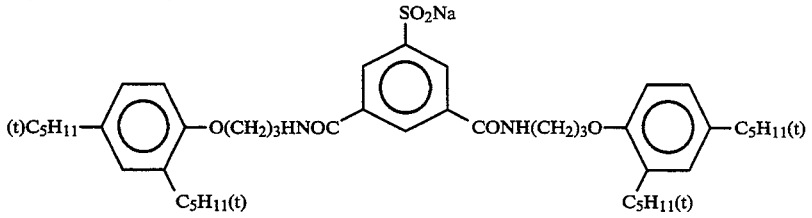
(Cpd-19) Color image stabilizer
2:4:4 (by weight) mixture of (1), (2) and (3):
(1)
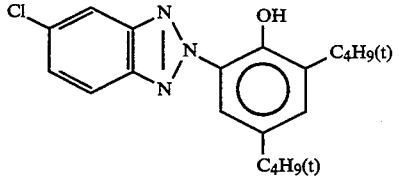

-continued
(2)
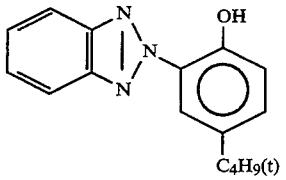
(3)
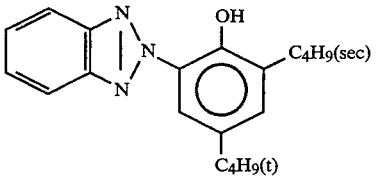
(Cpd-20) Color image stabilizer
1:1 (by weight) mixture of (1) and (2):
(1)
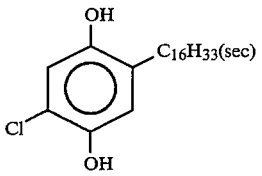
(2)
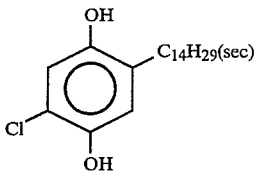
(UV-3) Ultraviolet absorbent
4:2:4 (by weight) mixture of (1), (2) and (3):
(1)
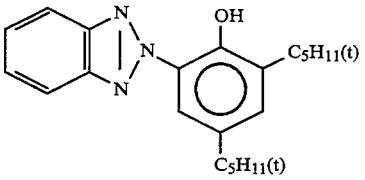
(2)
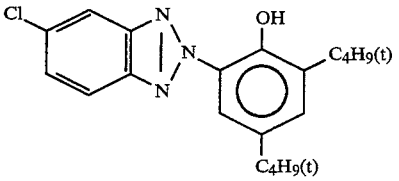
(3)
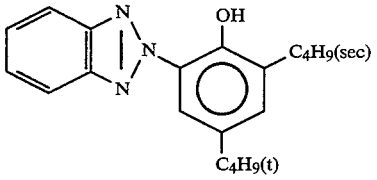
(Solv-7) Solvent
1:1 (by volume) mixture of (1) and (2):
(1)
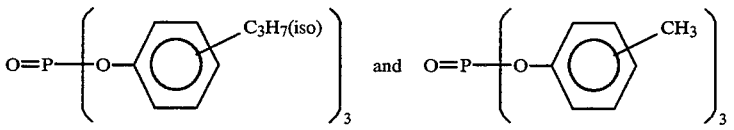
(Solv-8) Solvent -continued $O{=}P{-}(OC_9H_{19}(iso))_3$ (Solv-9) Solvent $$\begin{array}{l} COOC_8H_{17} \\ | \\ (CH_2)_8 \\ | \\ COOC_8H_{17} \end{array}$$

(Solv-19) Solvent
8:2 (by volume) mixture of (1) and (2):

(1)

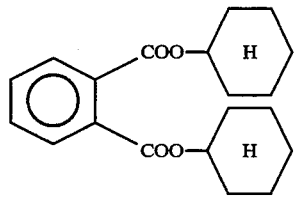

and $C_8H_{17}CH{-}CH{-}(CH_2)_7COOC_8H_{17}$ (O)

The thus prepared samples each underwent the same examinations as in Example 1. The results obtained are shown in Table II.

TABLE II

| Sample No. | Species of Fine-particle Powder 6th layer | Species of Fine-particle Powder 7th layer | Shape of Fine-particle Powder 6th layer | Shape of Fine-particle Powder 7th layer | Content (wt %) of Fine-particle Powder 6th Layer | Content (wt %) of Fine-particle Powder 7th Layer | Sensory Evaluation | Note |
|---|---|---|---|---|---|---|---|---|
| 201 | — | — | — | — | — | — | X | comparison |
| 202 | — | silica | — | globular | — | 20 | X | comparison |
| 203 | — | silica | — | globular | — | 50 | Δ | comparison |
| 204 | — | silica | — | nonblobular | — | 10 | Δ | comparison |
| 205 | — | silica | — | nonglobular | — | 20 | Δ | comparison |
| 206 | — | silica | — | nonglobular | — | 30 | ○ | invention |
| 207 | — | silica | — | nonglobular | — | 50 | ◎ | invention |
| 208 | silica | — | nonglobular | — | 50 | — | ◎ | invention |
| 209 | calcium carbonate | silica | nonglobular | nonglobular | 50 | 50 | ◎ | invention |
| 210 | | calcium carbonate | — | nonglobular | — | 50 | ◎ | invention |
| 211 | — | barium sulfate | — | nonglobular | — | 50 | ◎ | invention |
| 212 | alumina | silica | nonglobular | nonglobular | 50 | 50 | ◎ | invention |
| 213 | silica | titania | nonglobular | nonglobular | 50 | 30 | ◎ | invention |

The examination results set forth in Table II prove clearly that the samples of the present invention possess decided superiority over other samples. That is, the effects achieved by the present samples having the layer constitution different from that adopted in Example 1 has turned out to be very similar to those produced by the present samples prepared in Example 1.

In accordance with embodiments of the present invention, color photographs having excellent tone reproduction in the images, reduced dependence of the image quality upon the positions of viewing light sources and much feeling of massiveness in the image can be obtained even in rapid photographic processing.

What is claimed is:

1. A silver halide color photographic material comprising a reflecting support having thereon a cyan color-forming silver halide emulsion layer, a magenta color-forming silver halide emulsion layer, a yellow color-forming silver halide emulsion layer and at least one light-insensitive hydrophilic layer disposed farther from the support than any of these silver halide emulsion layers, wherein said light-insensitive hydrophilic layer contains nonglobular fine-particle powder in a dispersion in an amount of at least 35% by weight based on the whole components therein.

2. The silver halide color photographic material of claim 1, wherein the nonglobular fine-particle powder has an average particle size of from 0.6 to 5 μm.

3. The silver halide color photographic material of claim 1, wherein the amount of the nonglobular fine-particle powder is in the range of 50 to 95% by weight.

4. The silver halide color photographic material of claim 1, wherein the nonglobular fine-particle powder comprises an inorganic substance.

5. The silver halide color photographic material of claim 4, wherein the inorganic substance is an inorganic oxide, an alkaline earth metal salt or glass.

6. The silver halide color photographic material of claim 4, wherein the inorganic substance is silica.

7. The silver halide color photographic material of claim 1, wherein the reflecting support is a paper support having a waterproof resin coating filled with a white pigment in a density of at least 14% by weight on the emulsion layer-coated side.

8. The silver halide color photographic material of claim 1, wherein the light-insensitive hydrophilic layer containing nonglobular fine-particle powder is the layer disposed farthest from the support on the emulsion layer-coated side.

9. The silver halide color photographic material of claim 1, wherein the cyan color-forming silver halide emulsion layer, the magenta color-forming silver halide emulsion layer and the yellow color-forming silver halide emulsion layer each contains a high silver chloride emulsion having a silver chloride content of from 95 to 99.9 mole %.

10. The silver halide color photographic material of claim 9, wherein at least one of the emulsions comprises silver chlorobromide grains having bromide-localized phases at the surface thereof.

11. The silver halide color photographic material of claim 5, wherein said salt of an alkaline earth metal is a sulfate or carbonate salt.

12. The silver halide color photographic material of claim 11, wherein said salt is selected from the group consisting of barium sulfate, calcium carbonate, and magnesium sulfate.

13. The silver halide color photographic material claim 5, wherein the nonglobular fine-particle powder has an average particle size of from 0.6 to 5 μm and is contained in an amount in the range of 50 to 95% by weight.

* * * * *